US011773627B2

(12) United States Patent
Ancheta et al.

(10) Patent No.: US 11,773,627 B2
(45) Date of Patent: Oct. 3, 2023

(54) LOCK OUT TAG OUT PADLOCK

(71) Applicant: LAWRENCE LIVERMORE NATIONAL SECURITY, LLC, Livermore, CA (US)

(72) Inventors: Dione Ancheta, Livermore, CA (US); Raymond A. Swan, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 740 days.

(21) Appl. No.: 16/727,555

(22) Filed: Dec. 26, 2019

(65) Prior Publication Data

US 2021/0198923 A1 Jul. 1, 2021

(51) Int. Cl.
*E05B 67/38* (2006.01)
*G09F 3/02* (2006.01)
*E05B 63/14* (2006.01)

(52) U.S. Cl.
CPC ..... *E05B 67/383* (2013.01); *G09F 3/02* (2013.01); *E05B 63/143* (2013.01)

(58) Field of Classification Search
CPC ..... E05B 67/383; E05B 67/38; E05B 63/147; E05B 63/0004; E05B 63/142; E05B 2067/386; E05B 65/0007; E05B 65/00; E05B 65/0089; E05B 65/48; E05B 17/226; E05B 63/143; G09F 3/02; E05C 19/18; Y10T 292/34; Y10T 292/48; Y10T 292/31
See application file for complete search history.

(56) References Cited

U.S. PATENT DOCUMENTS 5,020,342 A * 6/1991 Doan ..... E05B 67/383 292/307 R
5,365,757 A * 11/1994 Primeau ..... E05B 67/383 292/307 R
8,408,609 B2 * 4/2013 Brojanac ..... E05B 67/383 292/307 R
9,059,533 B2 6/2015 Bogart et al.
9,501,046 B2 * 11/2016 Kalous ..... G07C 9/00309
9,881,749 B1 * 1/2018 Griffin ..... E05B 63/0004
10,844,634 B1 * 11/2020 Coleman ..... E05B 35/08
(Continued)

FOREIGN PATENT DOCUMENTS

WO 2014139007 A1 9/2014

*Primary Examiner* — Christine M Mills
*Assistant Examiner* — Yahya Sidky
(74) *Attorney, Agent, or Firm* — Eddie E. Scott

(57) ABSTRACT

A lockout padlock controls access to a hazardous energy source control box. The control box has a box body and a door that closes the box body. The door has an aperture. A staple is connected to the box body and the staple extends through the aperture in the door of the control box. A first lockout hinge part has a first lockout hinge part padlock hole. A second lockout hinge part has a second lockout hinge part padlock hole. The first lockout hinge part and the second lockout hinge part are position together to form a padlock pocket. A first padlock is positioned and locked in the staple. The first padlock is positioned in said padlock pocket and covered by said first lockout hinge part and said second lockout hinge part. A second padlock is positioned in the first lockout hinge part padlock hole and in said second lockout hinge part padlock hole.

19 Claims, 8 Drawing Sheets

(56) References Cited

U.S. PATENT DOCUMENTS

| | | | | |
|---|---|---|---|---|
| 2005/0028569 | A1* | 2/2005 | Turek | E05B 67/22 70/14 |
| 2011/0283753 | A1 | 11/2011 | Triffle | |
| 2014/0000324 | A1 | 1/2014 | Yeh | |
| 2019/0010734 | A1* | 1/2019 | Bhanpurawala | E05B 63/143 |

* cited by examiner

LOCK OUT TAG OUT PADLOCK

FEDERALLY SPONSORED RESEARCH AND DEVELOPMENT

The United States Government has rights in this application pursuant to Contract No. DE-AC52-07NA27344 between the United States Department of Energy and Lawrence Livermore National Security, LLC for the operation of Lawrence Livermore National Laboratory.

BACKGROUND

Field of Endeavor

The present application relates to safety requirements for the control of hazardous energy and more particularly to a lock out tag out safety system for the control of hazardous energy.

State of Technology

This section provides background information related to the present disclosure which is not necessarily prior art.

U.S. Pat. No. 5,365,757 for a safety lock provides the state of technology information below.

"It is recognized that accidents occurring in industrial environments are often a consequence of carelessness. Simple, low cost precautionary measures can sometimes make a big difference in industrial accident occurrence rate. One such known safety measure consists in providing a locking member having at least a few padlock shackles engaging bore means, wherein the keys for the various padlocks are to be held by a number of different persons. Therefore, if for example an electrician is working on an electrical line, it is critical that voltage not be applied to the line during such maintenance, otherwise severe injuries and/or death can occur by contacting a live electrical line. The electrician will have himself closed the power lever in the control box, but, if the electrician works at a distance from this electrical control box, he may not be able to detect the presence of another fellow worker who could think that "someone has again forgotten to put the power line on", and thus decided to reopen the electrical power lever. Having more than one padlock to lock such an electrical control box is desirable, since more than one person would need to authorize such unlocking, and any of these persons could put his veto on the unlocking of the locking device, a desirable safety feature."

U.S. Published Patent Application No. 2011/0283753 for a safety lockout hasp provides the state of technology information below.

"The supply of electrical energy to a machine often needs to be interrupted to allow for maintenance on the components of the machine. The person conducting the maintenance may need to access parts of the machine that could be harmful if energy is being supplied to the machine. The machine may have exposed electrical terminals, or the electrical energy may cause movement to the components that could cause physical harm to the person. The machine may be of such a size that the person is maintaining a part of the machine that is remote from the electrical switch, and the switch may be inadvertently turned on causing harm to the person maintaining the machine. Alternatively, multiple people may be conducting separate maintenance tasks on the machine, and it may not be clear that all those tasks are complete. One person may have left to collect replacement parts only to have the switch turned on in their absence. This may cause damage to the person when they return, or even damage the machine. It is therefore desirable to lockout the machine from the electricity source."

"The switch controlling the supply of electrical energy to the machine is often located within a box, whereby the lid to the box can be locked in a closed position with a padlock. The box may include a metal hoop, often referred to as a staple, which fits through an opening in the lid and receives the shackle of the padlock. Alternatively, the switch may include an aperture, which is exposed when the switch is in an "off" position, that accommodates the shackle to prevent it being moved to the "on" position. It is generally desirable for each person maintaining the machine to have their own padlock; however, the size of the aperture or staple will generally only accommodate a single shackle. Where more than one person is maintaining the machine, it is preferred to provide a safety lockout hasp as it can accommodate more than one padlock."

SUMMARY

Features and advantages of the disclosed apparatus, systems, and methods will become apparent from the following description. Applicant is providing this description, which includes drawings and examples of specific embodiments, to give a broad representation of the apparatus, systems, and methods. Various changes and modifications within the spirit and scope of the application will become apparent to those skilled in the art from this description and by practice of the apparatus, systems, and methods. The scope of the apparatus, systems, and methods is not intended to be limited to the particular forms disclosed and the application covers all modifications, equivalents, and alternatives falling within the spirit and scope of the apparatus, systems, and methods as defined by the claims.

When work is done on equipment that is normally connected to an energy source, such as electricity, pressure, or steam, personnel may be exposed to source-related hazards. The inventors' lock out/tag out apparatus, systems, and methods provide for the control of hazardous energy and address the practices and procedures necessary to disable machinery or equipment to prevent unexpected energization, start-up or release of stored energy, which may result in injury to employees during maintenance, servicing, or construction.

The inventor's lock out/tag out apparatus, systems, and methods have many uses. For example, the inventor's lock out/tag out apparatus, systems, and methods can be used all over the industries and around the world. When work is done on equipment that is normally connected to an energy source, such as electricity, pressure, and steam, personnel may be exposed to source-related hazards. The Lock Out/Tag Out (LOTO) provide safety requirements for the control of hazardous energy, and addresses the practices and procedures necessary to disable machinery or equipment to prevent unexpected energization, start-up or release of stored energy, which may result in injury to employees during maintenance, servicing, or construction. The inventor's lock out/tag out padlock apparatus, systems, and methods have advantages that include providing a simple fail-safe system. The inventor's lock out/tag out apparatus, systems, and methods also have advantages that include the use of standard padlocks.

In various embodiments the inventor's lock out/tag out padlock apparatus, systems, and methods provide a lockout padlock that controls access to a hazardous energy source control box. The control box has a box body and a door that closes the box body. The door has an aperture. A staple is connected to the box body and the staple extends through the aperture in the door of the control box. A first lockout hinge part has a first lockout hinge part padlock hole. A second lockout hinge part has a second lockout hinge part padlock hole. The first lockout hinge part and the second lockout hinge part are position together to form a padlock pocket. A first padlock is positioned and locked in the staple. The first padlock is positioned in said padlock pocket and covered by said first lockout hinge part and said second lockout hinge part. A second padlock is positioned in the first lockout hinge part padlock hole and in said second lockout hinge part padlock hole.

The apparatus, systems, and methods are susceptible to modifications and alternative forms. Specific embodiments are shown by way of example. It is to be understood that the apparatus, systems, and methods are not limited to the particular forms disclosed. The apparatus, systems, and methods cover all modifications, equivalents, and alternatives falling within the spirit and scope of the application as defined by the claims.

BRIEF DESCRIPTION OF THE DRAWINGS

The accompanying drawings, which are incorporated into and constitute a part of the specification, illustrate specific embodiments of the apparatus, systems, and methods and, together with the general description given above, and the detailed description of the specific embodiments, serve to explain the principles of the apparatus, systems, and methods.

DETAILED DESCRIPTION OF SPECIFIC EMBODIMENTS

Figure 1:
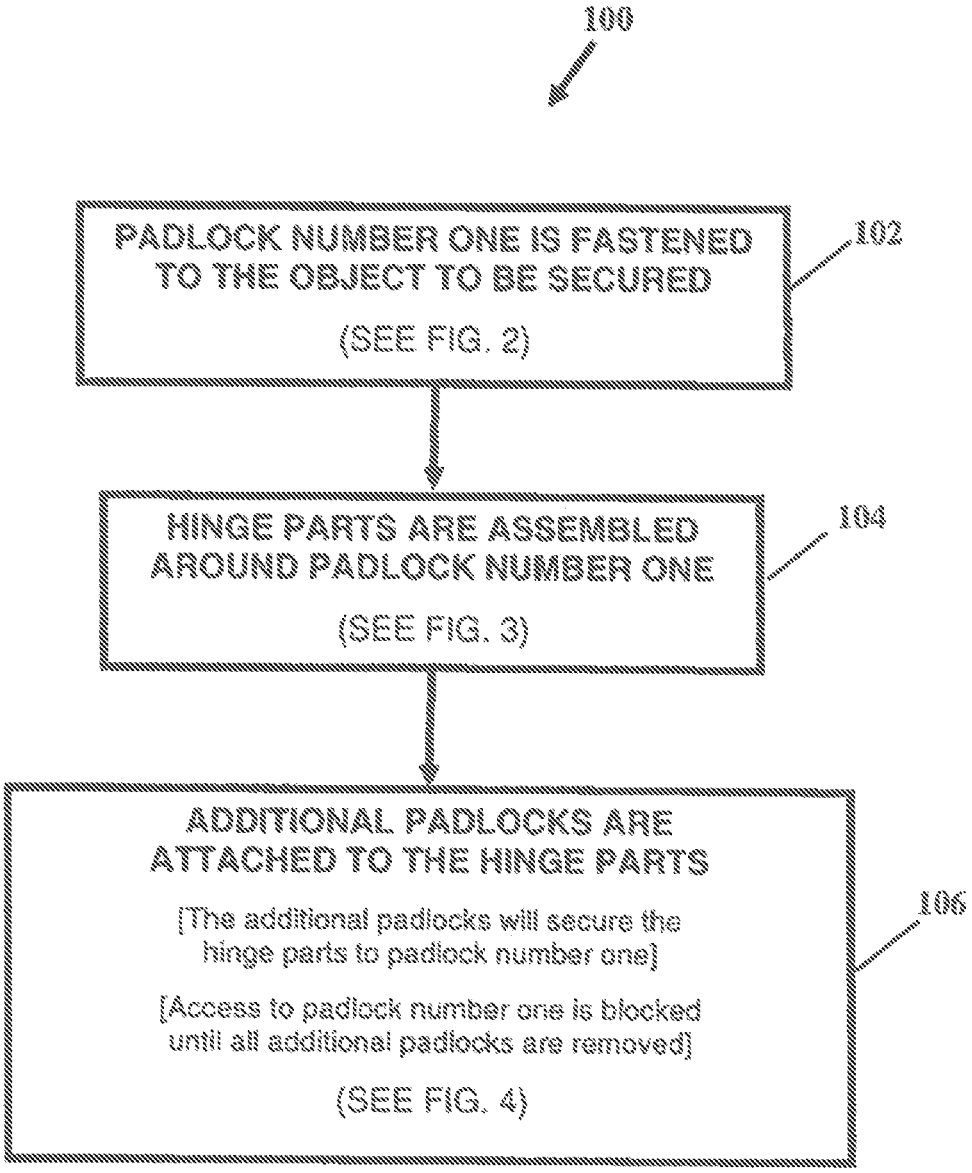
FIG. 1 is a flow chart illustrates one embodiment of the inventor's lock out/tag out apparatus, systems, and methods.

Referring to the drawings, to the following detailed description, and to incorporated materials, detailed information about the apparatus, systems, and methods is provided including the description of specific embodiments. The detailed description serves to explain the principles of the apparatus, systems, and methods. The apparatus, systems, and methods are susceptible to modifications and alternative forms. The application is not limited to the particular forms disclosed. The application covers all modifications, equivalents, and alternatives falling within the spirit and scope of the apparatus, systems, and methods as defined by the claims.

Energy sources including electrical, mechanical, hydraulic, pneumatic, chemical, thermal, or other sources in machines and equipment can be hazardous to workers. During the servicing and maintenance of machines and equipment, the unexpected startup or release of stored energy can result in serious injury or death to workers. The inventors' lock out/tag out apparatus, systems, and methods are safety procedures for ensuring that dangerous machines are properly shut off and not able to be started up again prior to the completion of maintenance or repair work. Hazardous energy sources are isolated and rendered inoperative before work is started on the equipment. The isolated power sources are "locked" and a warning tag is be placed on the locks. In various embodiments the warning tags identify the person with the key that unlocks the specific lock.

Referring now to the drawings, and in particular to FIG. 1, a flow chart illustrates one embodiment of the inventor's lock out/tag out padlock apparatus, systems, and methods. The invented lock out/tag out padlock apparatus, systems, and methods are illustrated in FIG. 1 and described in greater detail in examples. The inventor's lock out/tag out padlock apparatus, systems, and methods are designated generally by the reference numeral 100. The flow chart 100 includes the following steps:

Step #1 fasten padlock number one to the object to be secured (Reference Numeral-102);

Step #2-assembled hinge parts around padlock number one (Reference Numeral-104); and Step #3-attached additional padlocks to the hinge parts (Reference Numeral-106).

In step #1 the padlock number one is fasten to the object to be secured. The object to be secured is a control box for the control of hazardous energy. For example, the object to be secured can be a control box for the control of electricity, pressure, steam, or other hazardous energy.

In step #2 the hinge parts are assembled around padlock number one. The assembled hinge parts form a pocket for padlock number one.

In step #3 additional padlocks are connected to the hinge parts. This secures the assembled hinge parts around padlock number one.

The inventor's lock out/tag out padlock apparatus, systems, and methods are further described and illustrated by a number of examples. Various changes and modifications of these examples will be apparent to those skilled in the art from the description of the examples and by practice of the invention. The scope of the invention is not intended to be limited to the particular examples disclosed and the invention covers all modifications, equivalents, and alternatives falling within the spirit and scope of the invention as defined by the claims.

Figure 2:
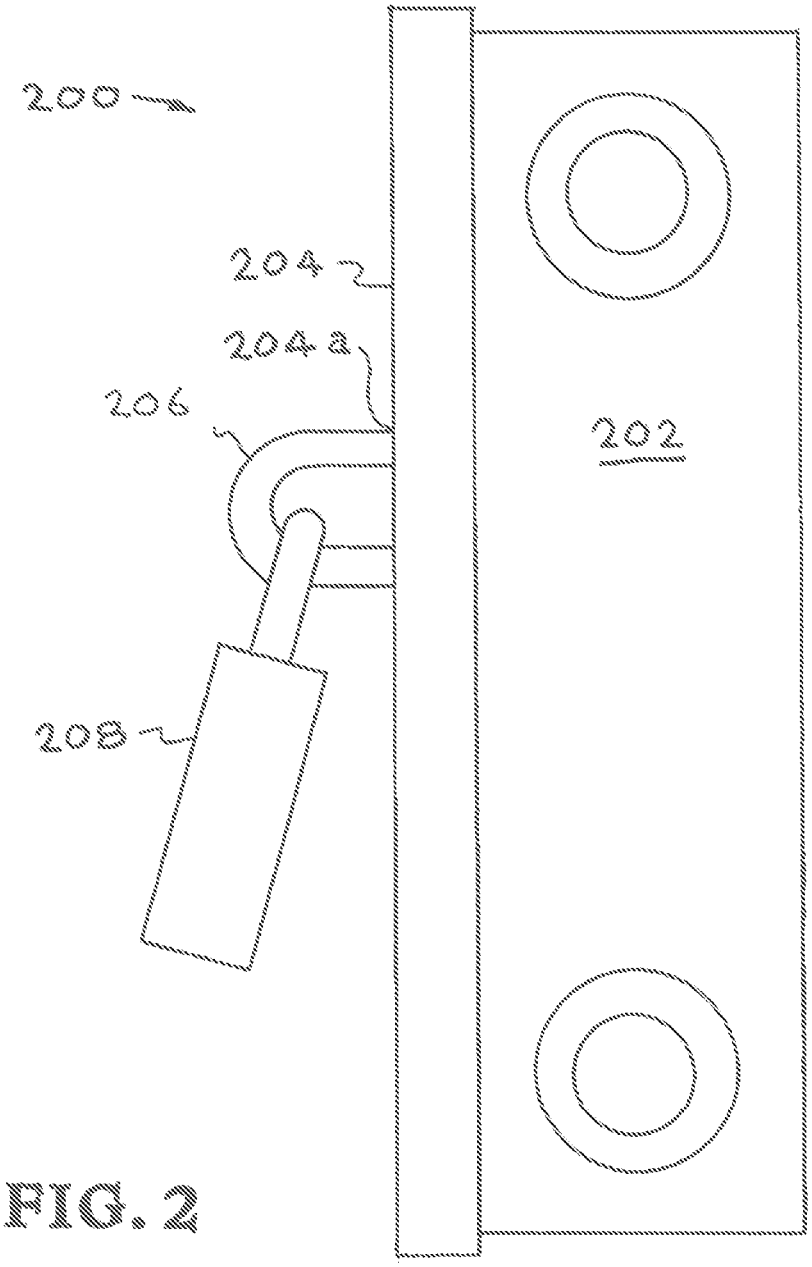
FIG. 2 illustrates padlock number one that is fastened to the object to be secured.

Referring to FIG. 2, an illustrative view shows one example embodiment of the inventor's lock out/tag out padlock apparatus, systems, and methods. This embodiment is identified generally by the reference numeral 200. FIG. 2 is an illustrative side view Applicant's padlock number one positioned and locked in a staple. The staple extends through an aperture in the door of a hazardous energy source control box. The components of the inventor's lock out/tag out padlock apparatus, systems, and methods illustrated in FIG. 2 are listed below.

Hazardous energy source control box body (Reference Numeral 202),

Control box door (Reference Numeral-204),

Aperture in control box door (Reference Numeral-204*a*),
Staple for receiving first padlock (Reference Numeral-206), and
First padlock (Reference Numeral-208).

The description of the structural components of the example embodiment of the inventor's lock out/tag out padlock apparatus, systems, and methods 200 having been completed, the operation and additional description of the inventor's lock out/tag out padlock apparatus, systems, and methods will now be considered in greater detail.

The inventor's lock out/tag out padlock apparatus, systems, and methods 200 provide a lockout apparatus for controlling access to a hazardous energy source control box wherein the control box includes a control box body 202 and a door 204 that closes the box body 202. The door 204 has an aperture 204*a*. A staple 206 is connected to the control box body 202. The staple 206 extends through the aperture 204*a* in the door 204 of the control box.

U.S. Pat. No. 5,365,757 for a safety lock in FIG. 1 of the drawings illustrates a typical electric box, to be mounted e.g. to the inside vertical wall of a house. The box has a front door hinged on one side and having an aperture through which extends a rigid arm (staple) projecting from the inside of the box. Arm (staple) has a bore at its outer free end. The bore of arm (staple) can be e.g. engaged by the U-shape shackle of a padlock.

Figure 3:
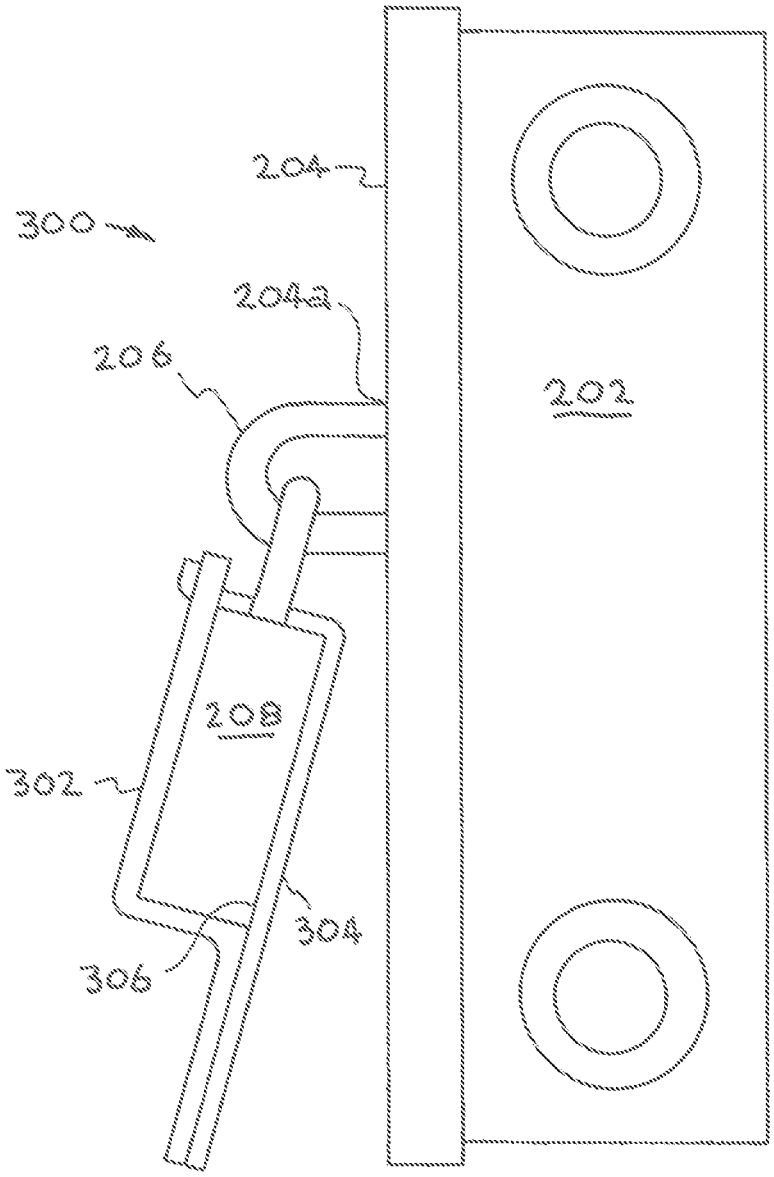
FIG. 3 illustrates the hinge parts that are assembled around Padlock number one.

Referring to FIG. 3, an illustrative view shows the example embodiment of Applicants' apparatus, systems, and methods described in step 2 of FIG. 1 and illustrated in FIG. 2. This example view of the embodiment is identified generally by the reference numeral 300. The inventor's lock out/tag out apparatus, systems, and methods 200 illustrated in FIG. 3 include a first hinge part and a second hinge part. The first hinge part and the second hinge part are position together to form a padlock pocket. The first padlock 208 is positioned and locked in the staple 206. Subsequently the first padlock 208 is positioned in the padlock pocket and covered by the first hinge part and the second hinge part.

FIG. 3 is an illustrative side view showing Applicant's hinge parts that are assembled around Padlock number one. The components of Applicant's hinge parts that are assembled around Padlock number one shown in FIG. 3 are listed below.

Hazardous energy source control box body (Reference Numeral 202),
Control box door (Reference Numeral-204),
Aperture in control box door (Reference Numeral-204*a*),
Staple for receiving first padlock (Reference Numeral-206),
Padlock number one fastened to the staple (Reference Numeral-208);
Hinge part A (Reference Numeral-302);
Hinge part B (Reference Numeral-304); and
Padlock pocket (Reference Numeral-306).

The inventor's lock out/tag out padlock apparatus, systems, and methods provide padlock number one that is fastened to the object to the staple 206. The Hinge part A 302 and Hinge part B 304 are positioned around padlock number one 208. The assembled hinge parts form a pocket 306 for padlock number one.

Figure 4:
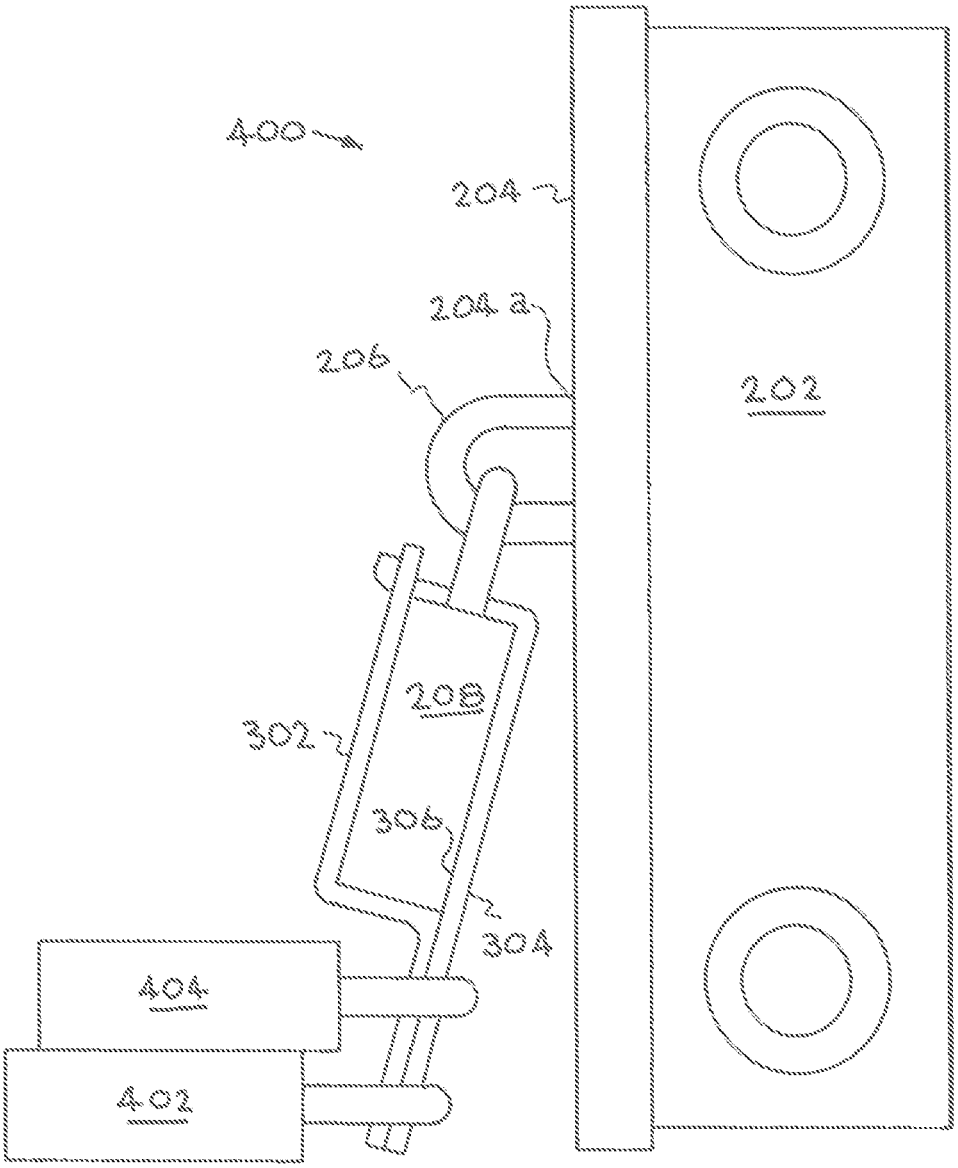
FIG. 4 illustrates additional padlocks attached to the hinge parts.

Referring to FIG. 4, an illustrative view shows the example embodiment of Applicants' apparatus, systems, and methods described in step 3 of FIG. 1 and show in FIGS. 2 and 3. This view is identified generally by the reference numeral 400. FIG. 4 is an illustrative side view showing that additional padlocks are attached to the hinge parts that are assembled around Padlock number one. The components of Applicant's additional padlocks that are assembled around the hinge parts and padlock number one shown in FIG. 4 are listed below.

Hazardous energy source control box body (Reference Numeral 202),
Control box door (Reference Numeral 204),
Aperture in control box door (Reference Numeral 204*a*),
Staple for receiving first padlock (Reference Numeral 206),
Padlock number one fastened to the staple (Reference Numeral-208);
Hinge part A (Reference Numeral-302);
Padlock pocket (Reference Numeral-306)
Hinge part B (Reference Numeral-304),
Addition padlock (Reference Numeral-402); and
Addition padlock (Reference Numeral-404).

The inventor's lock out/tag out padlock apparatus, systems, and methods provide padlock number one that is fastened to the object to be secured. The Hinge part A 302 and Hinge part B 304 are positioned around padlock number one 208. The first hinge part has a first hinge part padlock hole and the second hinge part has a second hinge padlock hole. A second padlock is positioned in the first hinge part padlock hole and in said second hinge part padlock hole. Addition padlock 402 and addition padlock 404 are positioned through hinge part A 402 and hinge part B 404 and locked. The additional padlocks will secure the hinge parts to padlock number one. Access to padlock number one is blocked until all padlocks are removed.

Figure 5:
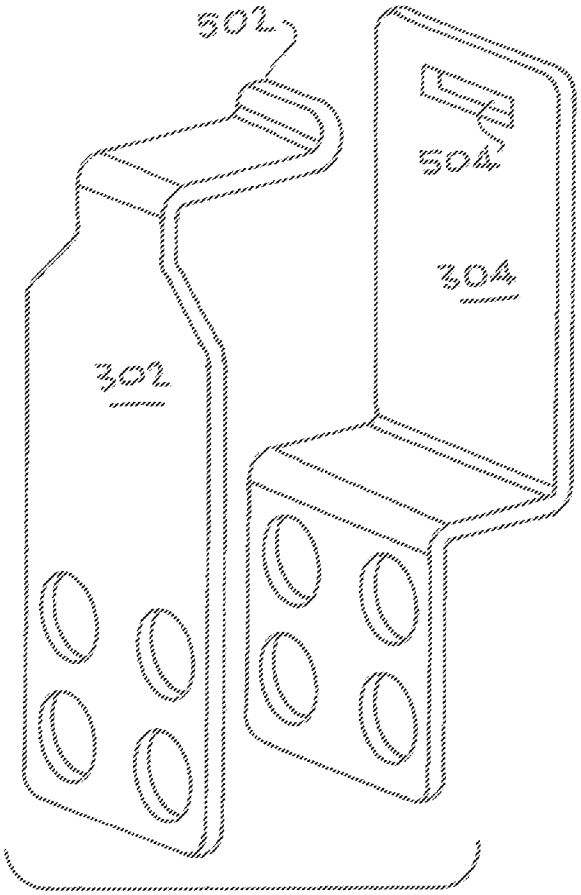
FIG. 5 illustrates the components of the hinge parts.

Referring to FIG. 5, an illustrative view shows hinge part A 302 and hinge part B 304 that were described in connection with the previous figures. The components of hinge part A 302 and hinge part B 304 are listed below.

Hinge part A (Reference Numeral-302);
Hinge part B (Reference Numeral-304);
Lip (Reference Numeral-502); and
Slot (Reference Numeral-504).

The Hinge part A 302 and Hinge part B 304 are positioned together to form a functioning hinge. The lip 502 fits within slot 504. The Hinge part A 302 and Hinge part B 304 are positioned around padlock number one 208. Addition padlocks are positioned through hinge part A 302 and hinge part B 204 and locked. The additional padlocks will secure the hinge parts to padlock number one. Access to padlock number one is blocked until all padlocks are removed.

Figure 6:
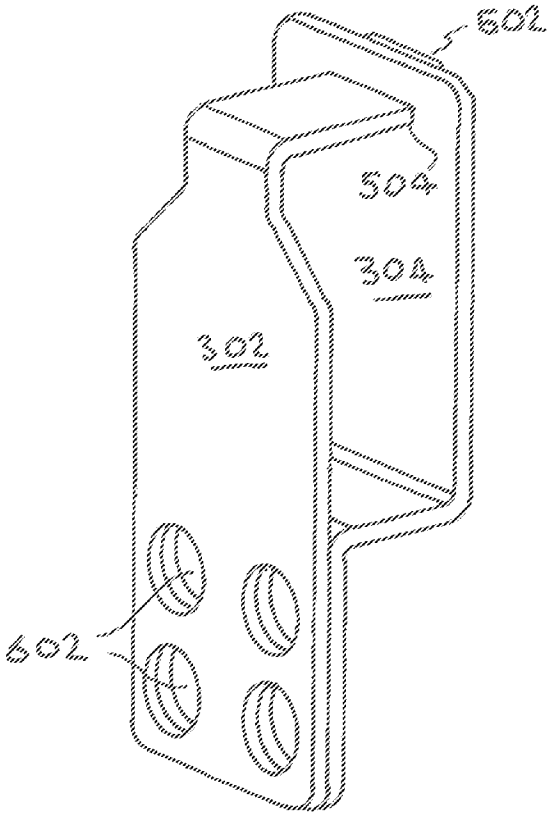
FIG. 6 shows the hinge parts assembled together.

Referring to FIG. 6, an illustrative view shows hinge part A 302 and hinge part B 304 positioned together to form a functioning hinge. The components of the functioning hinge are listed below.

Hinge part A (Reference Numeral-302);
Hinge part B (Reference Numeral-304);
Slot (Reference Numeral-504);
Lip (Reference Numeral-502); and
Holes for additional padlocks (Reference Numeral-602).

The Hinge part A 302 and Hinge part B 304 form a functioning hinge. The lip 502 is positioned within slot 504. The lip 502 positioned in slot 504 forms a functioning hinge. It is to be understood that other form of hinges may be use. In an alternative embodiment, the lip 502 positioned in slot 504 hinge is replaced with an alternative version of a hinge. U.S. Pat. No. 8,498,609 for a safety lockout hasp in FIGS. 1 and 2 of the drawings illustrates a hinge connecting first and second clasp members 21*a* and 21*b*. In an alternative embodiment, the lip 502 positioned in slot 504 hinge is replaced with hinge connecting first and second clasp members 21*a* and 21*b* illustrated in FIGS. 1 and 2 of U.S. Pat. No. 8,498,609.

The Hinge part A 302 and Hinge part B 304 are positioned around padlock number one. Addition padlocks are positioned through holes 602 in hinge part A 302 and hinge part B 404. The additional padlocks will secure the hinge parts to padlock number one. Access to padlock number one is blocked until all padlocks are removed.

Figure 7A:
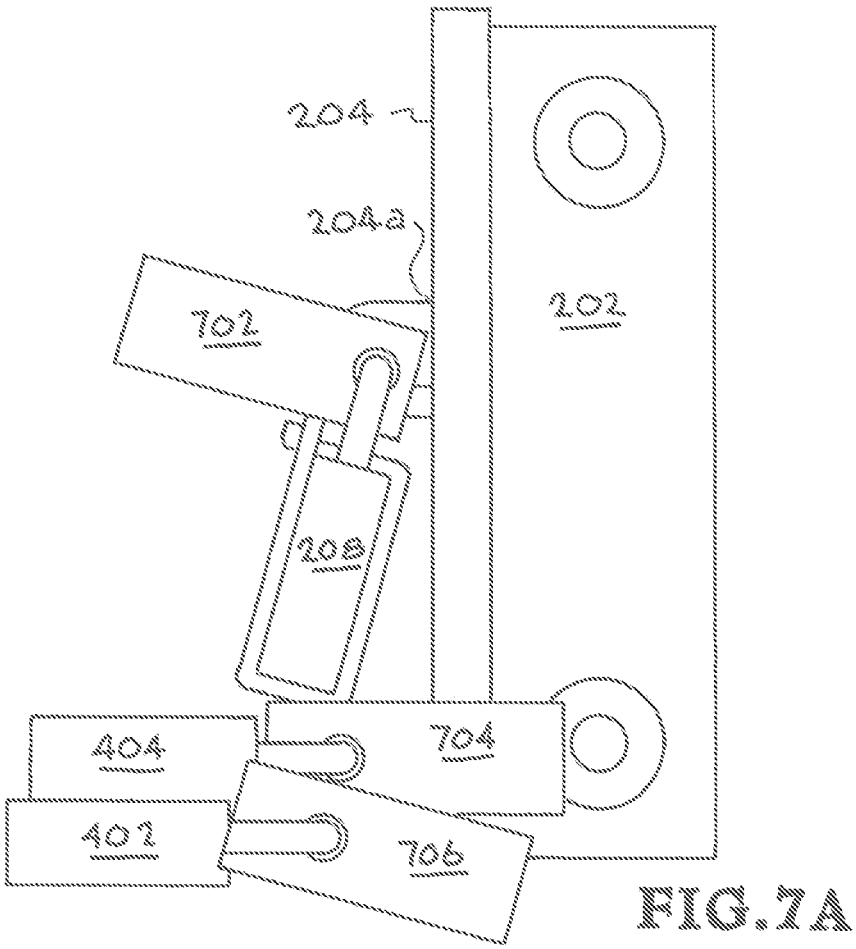
FIG. 7A shows tags attached to the padlocks.
Figure 7B:
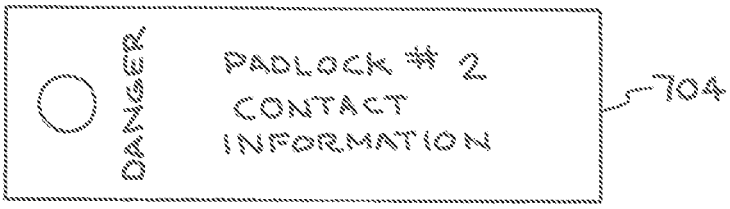
FIG. 7B shows one of the tags attached to one of the padlocks.

Referring to FIGS. 7A and 7B, tags attached to the padlocks are illustrated. FIG. 7A shows tags attached to all of the padlocks. FIG. 7B shows one of the tags attached to the second padlock of FIG. 7A. The components of Applicant's tags embodiment shown in FIGS. 7A and 7B are listed below.

Hazardous energy source control box body (Reference Numeral-202),
Control box door (Reference Numeral-204),
Aperture in control box door (Reference Numeral-204*a*),
Staple for receiving first padlock (Reference Numeral-206),
Padlock number one fastened to the staple (Reference Numeral-208);
Hinge part A (Reference Numeral-302);
Hinge part B (Reference Numeral-304),
Addition padlock (Reference Numeral-402);
Addition padlock (Reference Numeral-404);
Padlock number one tag (Reference Numeral-702);
Padlock number two tag (Reference Numeral-704); and
Padlock number three tag (Reference Numeral-706).

All of the lockout tags include a warning label. The first lockout tag 702 includes contact information for the key holder of the number one padlock 208. The second lockout tag 704 includes contact information for the key holder of padlock number two 402. The third lockout tag 706 includes contact information for the key holder of padlock number three 404.

Figure 8:
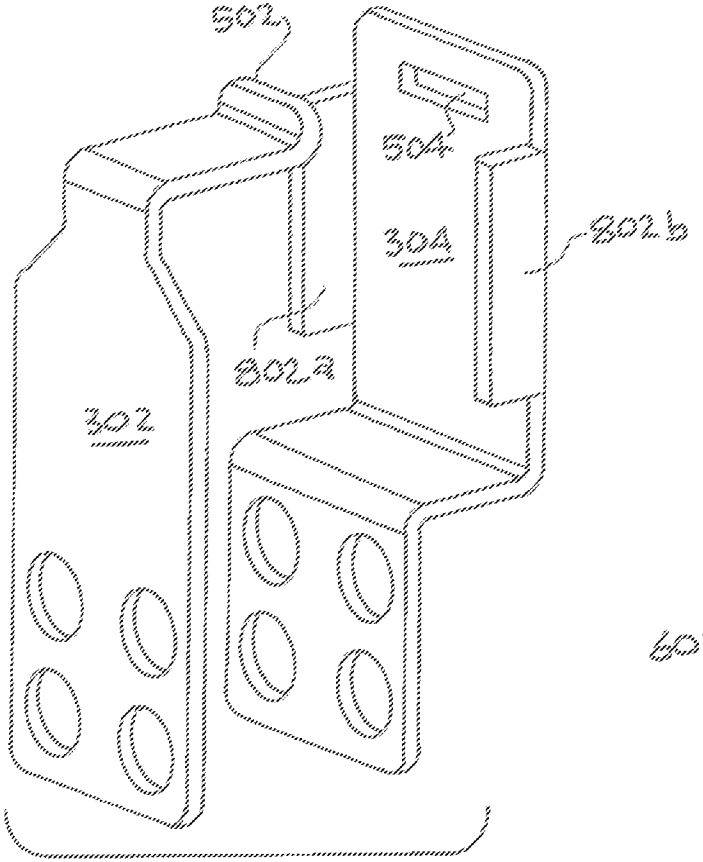
FIG. 8 illustrates the components of the hinge parts in another embodiment of the inventor's lock out/tag out apparatus, systems, and methods.

Referring to FIG. 8, the components of the hinge parts in another embodiment of the inventor's lock out/tag out apparatus, systems, and methods are shown. FIG. 8 is an illustrative view showing hinge part A 302 and hinge part B 304 that were described in connection with the previous figures. The components of the embodiment illustrated in FIG. 8 are listed below.

Hinge part A (Reference Numeral-302);
Hinge part B (Reference Numeral-304);
Slot (Reference Numeral-504);
Lip (Reference Numeral-502);
Side wall (Reference Numeral-802*a*); and
Side wall (Reference Numeral-802*b*).

The Hinge part A 302 and Hinge part B 304 are positioned together to form a functioning hinge. The Hinge part A 302 and Hinge part B 304 are position together to form a padlock pocket. The lip 502 fits within slot 504. Side wall 802*a* extends from one side of hinge part B and side wall 802*b* extends from the other side of hinge part B. The Hinge part A 302 and Hinge part B 304 are positioned around padlock number one in the padlock pocket. The side walls 802*a* and 802*b* function to prevent the enclosed padlock number one from being removed from the sides of the padlock pocket. Addition padlocks are positioned through hinge part A 302 and hinge part B 204 and locked. The additional padlocks will secure the hinge parts to padlock number one. Access to padlock number one is blocked until all padlocks are removed.

In an alternative embodiment side wall 802*a* extends from one side of hinge part A and side wall 802*b* extends from the other side of hinge part A. The Hinge part A 302 and Hinge part B 304 are positioned around padlock number one in the padlock pocket. The side walls 802*a* and 802*b* function to prevent the enclosed padlock number one from being removed from the sides of the padlock pocket.

Figure 9:
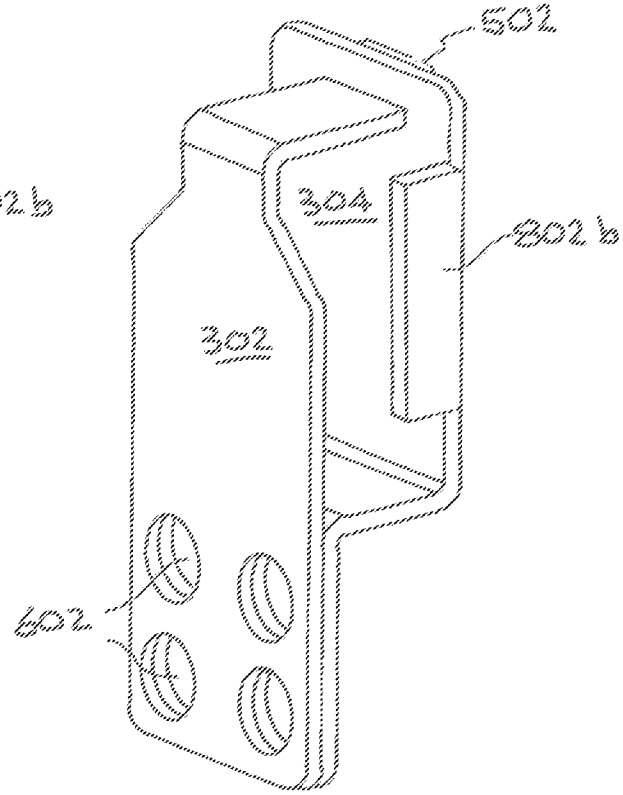
FIG. 9 shows the hinge parts illustrated in FIG. 8 assembled together.

Referring to FIG. 9, an illustrative view shows the hinge parts illustrated in FIG. 8 assembled together. Hinge part A 302 and hinge part B 304 are positioned together to form a functioning hinge. The components of the functioning hinge are listed below.

Hinge part A (Reference Numeral-302);
Hinge part B (Reference Numeral-304);
Slot (Reference Numeral-504);
Lip (Reference Numeral-502);
Holes for additional padlocks (Reference Numeral-602).
Side wall (Reference Numeral-802*a*); and
Side wall (Reference Numeral-802*b*).

The Hinge part A 302 and Hinge part B 304 form a functioning hinge. The Hinge part A 302 and Hinge part B 304 are position together to form a padlock pocket. The lip 502 fits within slot 504. Side wall 802*a* extends from one side of hinge part B and side wall 802*b* extends from the other side of hinge part B. The Hinge part A 302 and Hinge part B 304 are positioned around padlock number one in the padlock pocket. The side walls 802*a* and 802*b* function to prevent the enclosed padlock number one from being removed from the sides of the padlock pocket. Addition padlocks are positioned through hinge part A 302 and hinge part B 204 and locked. Addition padlocks are positioned through holes 602 in hinge part A 302 and hinge part B 404. The additional padlocks will secure the hinge parts to padlock number one. Access to padlock number one is blocked until all padlocks are removed.

Figure 10:
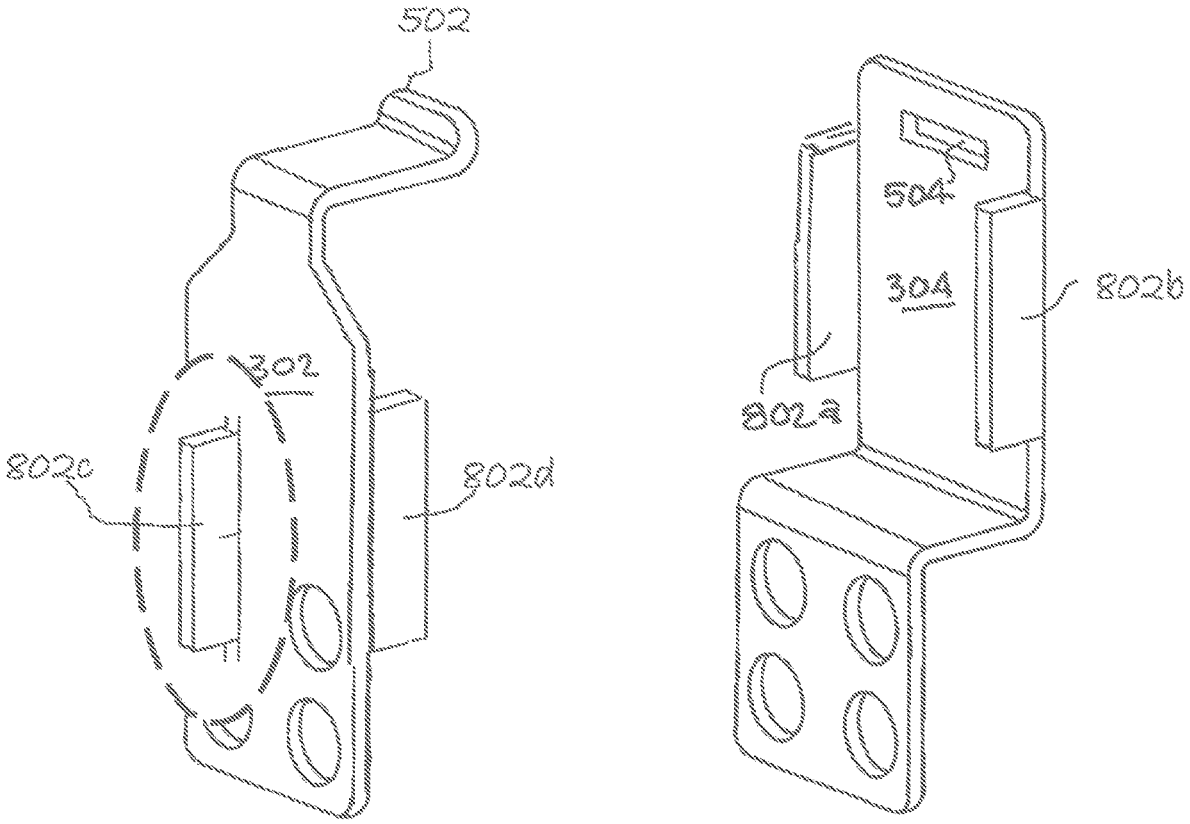
FIG. 10 illustrates the components of the hinge parts in yet another embodiment of the inventor's lock out/tag out apparatus, systems, and methods.

Referring to FIG. 10, an illustrative view shows another embodiment of the hinge parts that are illustrated in FIGS. 8 and 9. Like parts are given the same reference numbers. The components of the functioning hinge are listed below.

Hinge part A (Reference Numeral-302);
Hinge part B (Reference Numeral-304);
Slot (Reference Numeral-504);
Lip (Reference Numeral-502);
Holes for additional padlocks (Reference Numeral-602).
Side wall (Reference Numeral-802*a*);
Side wall (Reference Numeral-802*b*);
Side wall (Reference Numeral-802*c*); and
Side wall (Reference Numeral-802*d*).

The Hinge part A 302 and Hinge part B 304 form a functioning hinge. The Hinge part A 302 and Hinge part B 304 are positioned together to form a padlock pocket. The lip 502 fits within slot 504. Side wall 802*a* extends from one side of hinge part B (304) and side wall 802*b* extends from the other side of hinge part B (304). Side wall 802*c* extends from one side of hinge part A (302) and side wall 802*d* extends from the other side of hinge part A (302). The Hinge part A 302 and Hinge part B 304 are positioned around padlock number one in the padlock pocket. The side walls 802*a*, 802*b*, 302*c*, and 302*d* function to prevent the enclosed padlock number one from being removed from the sides of the padlock pocket. Addition padlocks are positioned through hinge part A 302 and hinge part B 204 and locked. Addition padlocks are positioned through holes 602 in hinge part A 302 and hinge part B 404. The additional padlocks will secure the hinge parts to padlock number one. Access to padlock number one is blocked until all padlocks are removed.

Although the description above contains many details and specifics, these should not be construed as limiting the scope of the application but as merely providing illustrations of some of the presently preferred embodiments of the apparatus, systems, and methods. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present application fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present apparatus, systems, and methods, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

While the apparatus, systems, and methods may be susceptible to various modifications and alternative forms, specific embodiments have been shown by way of example in the drawings and have been described in detail herein. However, it should be understood that the application is not intended to be limited to the particular forms disclosed. Rather, the application is to cover all modifications, equivalents, and alternatives falling within the spirit and scope of the application as defined by the following appended claims.

The invention claimed is:

1. A lockout padlock apparatus for controlling access to a hazardous energy source control box, comprising:

a staple positioned to control access to the hazardous energy source control box;

a first hinge part, said first hinge part having a first hinge part padlock hole and a first hinge part padlock pocket portion;

a second hinge part, said second hinge part having a second hinge part padlock hole and a second hinge part padlock pocket portion;

a hinge between said first hinge part and said second hinge part;

a completed padlock pocket wherein said first hinge part and said second hinge part are positioned together to form said completed padlock pocket with said first hinge part padlock pocket portion and said second hinge part padlock pocket portion and wherein said first hinge part padlock hole and said second hinge part padlock hole are aligned;

a first padlock located in said completed padlock pocket filling said completed padlock pocket and said first padlock locked in said staple; and a second padlock positioned and locked in said first hinge part padlock hole and in said second hinge part padlock hole.

2. The lockout padlock apparatus for controlling access to the hazardous energy source control box of claim 1, wherein said hinge comprises a first lockout hinge part lip in first lockout hinge part and a second lockout hinge part slot in said second lockout hinge part, wherein said first lockout hinge part lip is located in said second lockout hinge part slot.

3. The lockout padlock apparatus for controlling access to the hazardous energy source control box of claim 1, further comprising:

a first side wall on said second hinge part and a second side wall on said second hinge part wherein said first side wall and said second side wall oppose each other and form a portion of said padlock pocket.

4. The lockout padlock apparatus for controlling access to the hazardous energy source control box of claim 1, further comprising:

a first side wall on said first hinge part and a second side wall on said second hinge part wherein said first side wall and said second side wall oppose each other and form a portion of said padlock pocket.

5. The lockout padlock apparatus for controlling access to the hazardous energy source control box of claim 1, further comprising:

an additional first hinge part padlock hole in said first hinge part;

an additional second hinge part padlock hole in said second hinge part, wherein said additional first hinge part padlock hole and said additional second hinge part padlock hole are aligned; and a third padlock positioned in said first hinge part additional padlock hole and in said second hinge part additional padlock hole.

6. The lockout padlock apparatus for controlling access to the hazardous energy source control box of claim 1, further comprising a first lockout tag, said first lockout connected to said first padlock; and a second lockout tag, said second lockout connected to said second padlock.

7. The lockout padlock apparatus for controlling access to the hazardous energy source control box of claim 1, further comprising a first lockout tag that includes a warning label and second lockout tag that includes a warning label.

8. The lockout padlock apparatus for controlling access to the hazardous energy source control box of claim 1, further comprising a first lockout tag that includes contact information for a first padlock key holder and a second lockout tag that includes contact information for a second padlock key holder.

9. The lockout padlock apparatus for controlling access to the hazardous energy source control box of claim 1, wherein said first padlock and said second padlock are the same size.

10. A lockout apparatus for controlling access to a hazardous energy source control box wherein the control box includes a box body and a door that closes the box body and wherein the door has an aperture, comprising:

a staple connected to the box body wherein said staple extends through the aperture in the door of the control box;

a first lockout hinge part, said first lockout hinge part having a first lockout hinge part padlock hole and a first lockout hinge part padlock pocket portion;

a second lockout hinge part, said second lockout hinge part having a second lockout hinge part padlock hole and a second lockout hinge part padlock pocket portion;

a hinge between said first lockout hinge part and said second lockout hinge part, wherein said first lockout hinge part and said second lockout hinge part and said hinge are position together to form a completed padlock pocket;

a first padlock located and locked in said staple, wherein said first padlock is located in said completed padlock pocket and covered by said first lockout hinge part and said second lockout hinge part and filling said completed padlock pocket; and a second padlock positioned and locked in said first lockout hinge part padlock hole and in said second lockout hinge part padlock hole.

11. The lockout apparatus for controlling access to the hazardous energy source control box of claim 10, wherein said hinge comprises a first lockout hinge part lip in first lockout hinge part and a second lockout hinge part slot in said second lockout hinge part, wherein said first lockout hinge part lip is located in said second lockout hinge part slot.

12. The lockout apparatus for controlling access to the hazardous energy source control box of claim 10 further comprising a first side wall on said second lockout hinge part and a second side wall on said first lockout hinge part wherein said first side wall and said second side wall oppose each other and form a portion of said padlock pocket.

13. The lockout apparatus for controlling access to the hazardous energy source control box of claim 10 further comprising a first side wall on said first lockout hinge part and a second side wall on said second lockout hinge part wherein said first side wall and said second side wall oppose each other and form a portion of said padlock pocket.

14. The lockout apparatus for controlling access to the hazardous energy source control box of claim 10 further comprising a first lockout hinge part additional padlock hole in said first lockout hinge part;

a second lockout hinge part additional padlock hole in said second lockout hinge part; and a third padlock positioned in said first lockout hinge part additional padlock hole and in said second lockout hinge part additional padlock hole.

15. The lockout apparatus for controlling access to the hazardous energy source control box of claim 10 further comprising a first lockout tag, said first lockout connected to said first padlock; and a second lockout tag, said second lockout connected to said second padlock.

16. The lockout apparatus for controlling access to the hazardous energy source control box of claim 10, further comprising a first lockout tag that includes a warning label and a second lockout tag that includes a warning label.

17. The lockout apparatus for controlling access to a hazardous energy source control box of claim 10, further comprising a first lockout tag that includes contact information for a first padlock key holder and a second lockout tag that includes contact information for a second padlock key holder.

18. The lockout apparatus for controlling access to the hazardous energy source control box of claim 10 wherein said first padlock and said second padlock are the same size.

19. A lockout method for controlling access to a hazardous energy source control box wherein the control box includes a box body and a door that closes the box body and wherein the door has an aperture, comprising the steps of:

providing a staple connected to the box body that extends through the aperture in the door of the control box;

providing a first lockout hinge part, a second lockout hinge part, and a hinge between said first lockout hinge part and said second lockout hinge part, wherein said first lockout hinge part has a first lockout hinge part padlock hole and a first hinge part padlock pocket portion, wherein said second lockout hinge part has a second lockout hinge part padlock hole and a second hinge part padlock pocket portion, and wherein said first lockout hinge part and said second lockout hinge part and said hinge are position together to form a completed padlock pocket;

locating and locking a first padlock in said staple:

locating said first padlock in said padlock pocket filling said padlock pocket and covered by said first lockout hinge part and said second lockout hinge part; and a second padlock in said first lockout hinge part padlock hole and in said second lockout hinge part padlock hole and locking said second padlock.

* * * * *